United States Patent [19]

Trotman et al.

[11] 4,143,916

[45] Mar. 13, 1979

[54] UNDER-BODY VENTILATING SEAT CUSHION

[76] Inventors: Herbert H. Trotman; Helen H. Trotman, both of P. O. Box 807, Virginia Beach, Va. 23451

[21] Appl. No.: 771,094

[22] Filed: Feb. 23, 1977

[51] Int. Cl.[2] ..... A47C 23/00

[52] U.S. Cl. ..... 297/453; 5/347

[58] Field of Search ..... 5/347; 297/453

[56] References Cited

U.S. PATENT DOCUMENTS

| | | | |
|---|---|---|---|
| 3,162,487 | 12/1964 | Trotman | 297/453 |
| 3,514,156 | 5/1970 | Fields | 297/453 |
| 3,940,183 | 2/1976 | Seltzeret al. | 297/453 |

*Primary Examiner*—James C. Mitchell

*Attorney, Agent, or Firm*—Shanley, O'Neil and Baker

[57] ABSTRACT

A ventilating seat cushion for use between a body and a supporting surface which comprises a panel or grid in the form of a sheet of resilient plastic material having a plurality of protuberances arranged in columns and rows which act to support the body in spaced relation to the supporting surface with a lattice of channels formed by the protuberances between the supporting surface and the body for ventilation, certain of the protuberances being star-shaped in plan view, each star-shaped protuberance including portions extending toward adjacent protuberances in the associated row and portions extending toward adjacent protuberances in the associated column, the extending portions of adjacent protuberances in adjacent rows overlapping each other in the direction of the columns and the extending portions of the adjacent protuberances in adjacent columns overlapping each other in the direction of the rows to stiffen the sheet of plastic material against flexure along any straight line extending across the support panel.

9 Claims, 7 Drawing Figures

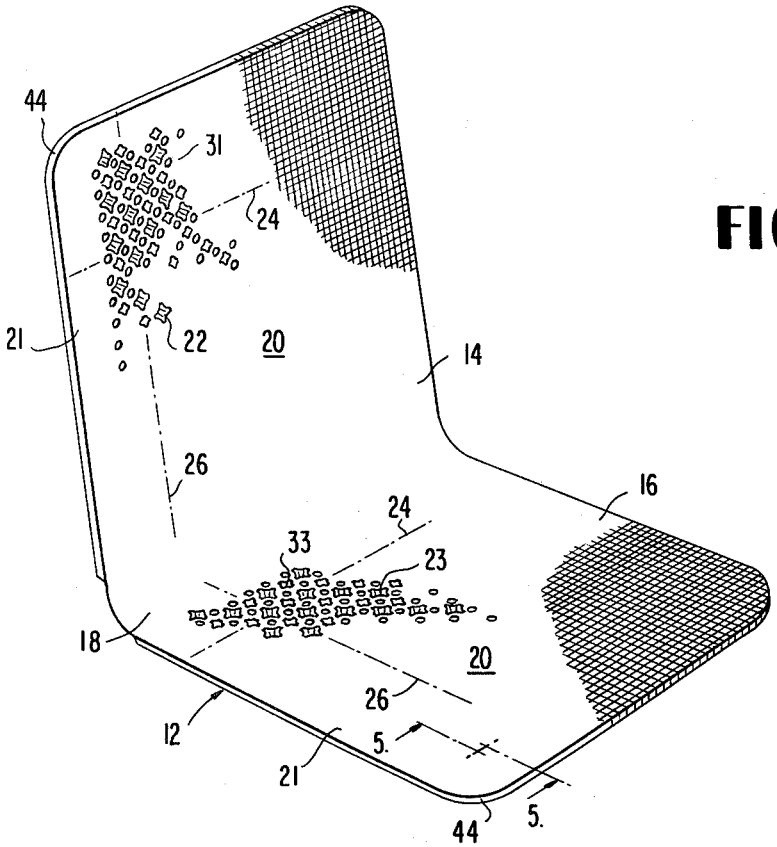
FIG. 1
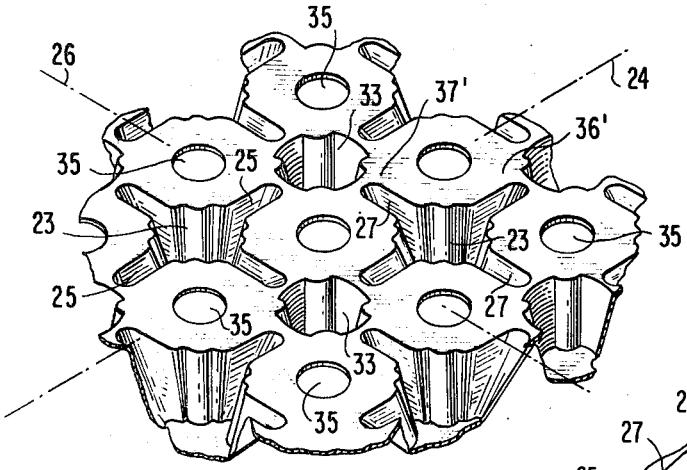
FIG. 2
FIG. 3
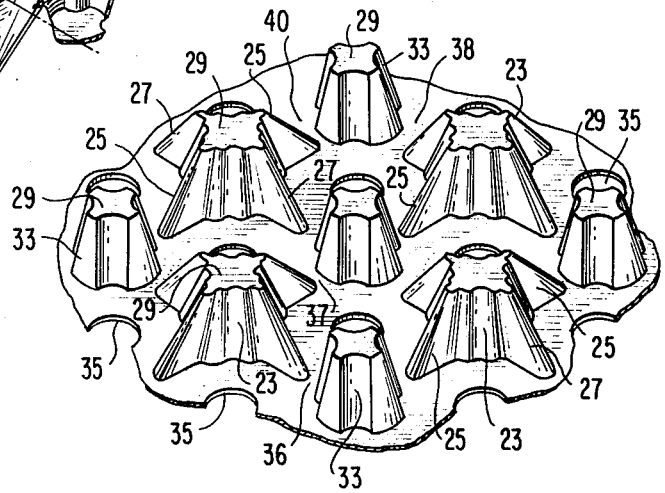

UNDER-BODY VENTILATING SEAT CUSHION

BACKGROUND OF THE INVENTION

Applicant's prior U.S. Pat. Nos. 3,162,487 and 3,162,488 disclose under-body ventilating seat cushions which have protuberances formed in sheets of plastic material, which protuberances coact with other elements of the seat to space a body above the supporting surface. The sheets of plastic material in these patents depend in good part on inherent stiffness of the plastic sheet to resist objectionable flexure in use thereby requiring expensive heavy gage sheet material. The seat cushions of these patents require additional elements, including perimeter stiffening devices and reinforcing sheets in addition to the usual covering material on the seat cushion.

In addition to the foregoing described disadvantages, known seat cushions of the prior art were too flexible to adequately support the body, deforming excessively and thereby decreasing the ventilation through the seat as well as providing less support to the body. Some prior art seat cushions have complex constructions making them expensive to manufacture. Other prior art seat cushions achieved resilient support by the use of metallic springs which are expensive and such cushions usually required frames.

Applicant has desired to develop an all plastic seat cushion that would not necessarily have to have fabric covering it nor reinforcing sheets embodied in it. Applicant also has desired to develop an all plastic seat cushion that would have some spring action and an all plastic seat cushion that would eliminate the necessity of perimeter stiffening devices.

SUMMARY OF THE INVENTION

A support panel for use as a ventilated body support member comprising a plurality of protuberances arranged in columns and rows, each of a plurality of the protuberances including a transversely extending portion and a longitudinally extending portion projecting from an intermediate portion to define a star-shaped element, the transversely extending portion being disposed along a direction parallel to the direction of the rows and the longitudinally extending portion being disposed along a direction parallel to the direction of the columns, the star-shaped elements extending between two spaced substantially parallel faces of the panel, each of the star-shaped elements having a flat surface disposed in one of the faces and having wall portions extending from the periphery of the flat surface in the one face to the other face, connecting portions collectively defining the other of the faces and extending between the wall portions in the other of said faces for connecting adjacent star-shaped elements, the star-shaped elements in adjacent rows being staggered and intermeshed, with longitudinally extending portions of star-shaped elements along the direction of the rows being disposed between longitudinally extending portions of star-shaped elements in adjacent columns and transversely extending portions of star-shaped elements along the direction of the rows being disposed between adjacent transversely extending portions of star-shaped elements in adjacent rows, the star-shaped elements providing a lattice of elongate channels each extending about the periphery of an associated star-shaped element and oriented parallel to one of the directions of the rows and columns with the continuity between said channels aligned along the directions parallel to said rows and columns being repeatedly interrupted by said star-shaped elements, whereby the stiffness of the panel is enhanced and excessive flexing thereof is prevented along all directions along said panel including the longitudinal and transverse directions of said columns and rows respectively when a body is supported on the member, and said channels are provided to permit the flow of ventilating air therethrough.

BRIEF DESCRIPTION OF THE DRAWINGS

FIG. 1 is a perspective view of a preferred embodiment of the present invention;

FIG. 2 is an enlarged fragmentary view in perspective of a portion of the panel illustrated in FIG. 1;

FIG. 3 is an enlarged fragmentary view in perspective of the portion of the panel of FIG. 2 reversed to show the underside of the portion;

DESCRIPTION OF THE PREFERRED EMBODIMENT

Figure 4:
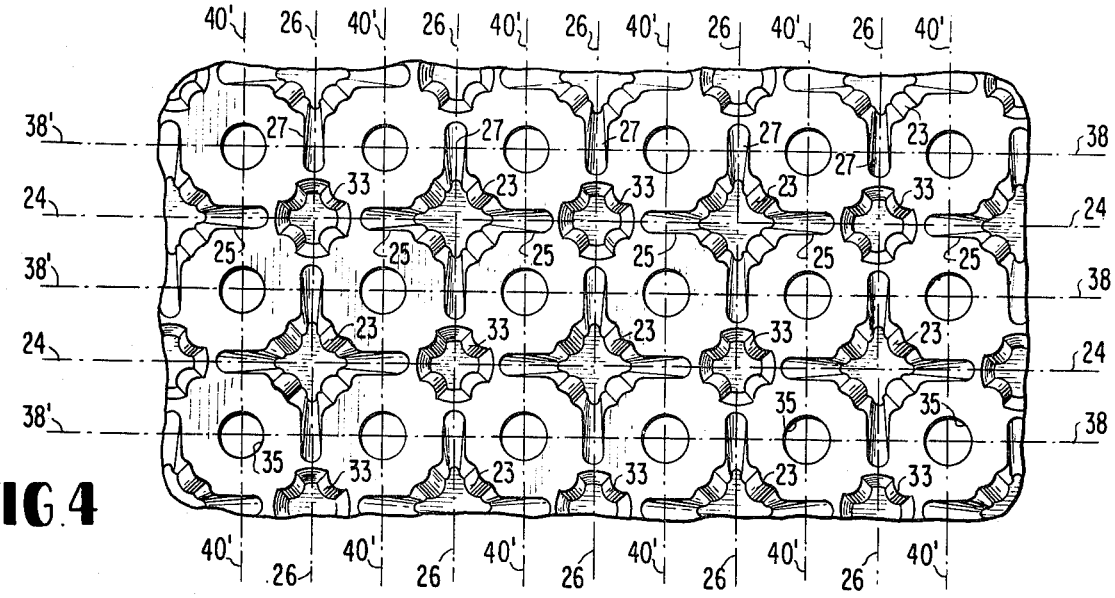
FIG. 4 is a plan view of the underside of the panel illustrated in FIG. 1.

Referring now to the drawings wherein identical or similar parts are designated by the same reference numerals throughout and first referring to FIGS. 1 to 4, a car seat is shown which incorporates a support panel or seat component 12. Although a car seat cushion is illustrated and described, the invention extends to other body support devices. The panel 12 includes a back support portion 14 and a seat support portion 16 connected to each other by an integral hinge 18. The panel 12 incorporated protuberances and may be formed from any suitable material, the presently preferred embodiment being vacuum formed from a thin sheet of resilient elastomeric or plastic material, such as a polyvinyl or high density polyethylene.

Each support portion 14, 16 includes a body support area 20 surrounded and circumscribed by a marginal portion 21 of the sheet of plastic material. Within each central or body support area 20 is a grid or array of protuberances in the form of star-shaped elements or sections 22, 23 arranged in transverse rows 24 and longitudinal columns 26. The star-shaped elements 22 formed on the back support portion 14 and the elements 23 formed on the seat support portion 16 are shown to be identical. However, the star-shaped elements 22 and 23 need not be identical as long as they supply to the back and seat support portions 14, 16 the requisite rigidity as to be described. In each row and column of both support portions, protuberances 31, 33 are shown alternating with the star-shaped elements and it will be apparent that in the form of invention illustrated each star-shaped element is a protuberance having an intermediate portion and portions 25, 25 extending in the direction of the transverse rows 24 and portions 27, 27 extending in the direction of the longitudinal columns 26.

Referring to FIGS. 2 and 3, the details of the grid or array of star-shaped sections 22, 23 is shown in more detail. In the presently preferred embodiment, as already mentioned, each of the star-shaped elements 22, 23 comprises transversely extending portions 25 and longitudinally extending portions 27. Elements 22, 23 and extending portions 25, 27 can be of any desired dimensions so long as extending portions 25, 27 overlap or intermesh to enhance the stiffness of panel 12 while permitting unobstructed flow of air under the supported body.

All the protuberances can be star-shaped in plan as at 22, 23 or, as shown in the drawings, alternate protuberances can be star-shaped with the other protuberances 31, 33 being essentially columnar but with enough slope to the sides of the column to provide a sufficient draft for vacuum forming. Where it is desired to have all the protuberances star-shaped, they would retain the same relative positions to one another as in the illustrated form of panel although their spacing apart might be reduced. It will be evident that where the columnar protuberances are interspersed with the star-shaped protuberances as shown in the drawings, the columnar protuberances can be considered as acting as extensions of the extending portions of the star-shaped protuberances and the appended claims are intended to embrace both forms of panel with and without the columnar protuberances. Each of the protuberances 31, 33 is shaped similarly to the protuberances in Trotman U.S. Pat. No. 3,162,487 with vertically disposed reinforcing ribs in the sidewalls so that the top flat surface is somewhat cross-shaped in plan. All the protuberances have a flat top 29 with all the flat tops being coplanar for attachment to another panel or a planar sheet, as described below. It will be evident that the star-shaped protuberances 22, 23 are similar to the ones in applicant's prior U.S. Pat. No. 3,162,487 except that each star-shaped protuberance has the body extension portion extending on each side in the direction of the row the protuberance is in and another body extension portion extending on each side in the direction of the column the protuberance is in. In the embodiment illustrated, these body extensions extend almost to the adjacent columnar protuberances 31, 33. Inspection of the drawing will disclose that with the star-shaped protuberances 22, 23 alternating in the rows and columns with columnar protuberances 31, 33, the body extensions on adjacent star-shaped protuberances in adjacent rows will intermesh with or overlap each other looking in the direction of the columns run and the body extensions on adjacent star-shaped protuberances in adjacent columns will intermesh with or overlap each other looking in the direction the rows run. This results in the panel or sheet of plastic material being rigidified against undesirable flexure. As in the case of the columnar protuberances, the body extensions on the star-shaped protuberances are sloped to facilitate their formation by vacuum molding.

The star-shaped elements 22, 23 and protuberances 31, 33 are three dimensional and have the height or thickness of the panel 12. These elements extend between and collectively define two spaced substantially parallel faces of panel 12 as will become evident from the description that follows.

Each of the flat tops 29 of star-shaped elements 22, 23 is star-shaped and is disposed in the associated one of the upper faces of the panel and has wall portions which slope downwardly in all directions to the other or lower face of the panel where the respective elements are connected to each other by the sheet plastic material as shown and to be described. In addition to other advantages, the wall portion sloping surfaces on all the protuberances permit the grids to be stacked for storage by nesting corresponding protuberances inside one another and further provide the necessary draft to facilitate mold removal.

An important feature of the present invention is that the star-shaped elements 22, 23 are arranged in the rows 24 and columns 26 with the body portion extensions 25, 27 in adjacent rows being staggered and intermeshed to form substantially uniform elongate transverse spaces 36 and elongate longitudinal spaces 37 therebetween. Elongate connecting sheet material portions 36', 37' collectively define the other or lower face of the panel 12 and extend between adjacent facing or opposing wall portions of body portion extensions 25, 27 and are coextensively disposed in opposition to the elongate spaces 36, 37 to form a lattice of elongate channels 38, 40, each extending about the periphery of an associated star-shaped section 22, 23.

The transverse channels formed between the body portion extensions 25 are designated by the reference numeral 38 and the longitudinal channels formed between body portion extensions 27 are designated by the reference numerals 40. These channels which are in effect segments, are oriented in directions parallel to one of the directions of the rows 24 and columns 26. An important feature of the present invention is that the star-shaped elements 22, 23 are arranged to repeatedly interrupt the continuity between both channels 38 and 40 aligned along directions parallel to the rows and columns 24, 26 to enhance the stiffness of the panel 12 and to prevent excessive flexing of the same along the channels 38, 40 when a body is supported on the sheet, while at the same time providing paths which permit flow of ventilating air through channels.

Referring to FIG. 4, the principle of the present invention will now be described. The reference numerals 38' designate lines parallel to the rows 24 along which channels or channel segments 38 are formed and are aligned. It will be noted that the channels 38 are repeatedly interrupted along the lines 38' by spaced longitudinally extending portions 27 in every column 26. Similarly, the reference numerals 40' designate those lines parallel to the directions of the columns 26 along which channel or channel portions 40 are aligned. Here the transversely extending portions 25 of the sections 22 in every row 24 are shown to repeatedly interrupt the continuity of the channels 40 along the lines 40'. Accordingly, flexing of the panel 12 along the lines 38' and 40' is minimized and the stiffness of the panel is substantially enhanced. Excessive flexing of the panel 12 is prevented along all directions of the panel including the transverse directions of the rows 24 and the longitudinal direction of the columns 26 when a body is supported on the panel. However, because the channels 38 and 40 are interconnected with one another, these provide a grid of channels which permit free flow of ventilating air therethrough. It will be noted that the channels extend in a straight line in the direction of the rows and in a straight line in the direction of the columns. On the other hand, it will be apparent that in directions disposed diagonally to the rows or columns, channels are present for the free flow of ventilating air, which channels are zigzag in configuration being interrupted by the main body portion of diagonally aligned protuberances. It follows that there is resistance to excessive flexing and provision for the free flow of ventilating air in all directions.

The flow of air for ventilating purposes just described could enter the channels anywhere along the channels not blocked by the supported body. However, to further enhance the air ventilation of the seat cushion, ventilating holes 35, are located in the sheet between protuberances. Of course, such ventilating holes could be through the top surfaces of the protuberances but in such case a sheet of material superposed on the top side of the grid for appearance and comfort purposes could not be readily attached to the tops of the protuberances.

In accordance with the presently preferred embodiment, there is provided a bead 44 formed in marginal portion 21 and surrounding the support area of the sheet of plastic material which incorporates the protuberances, this peripheral bead serving to stiffen the marginal portion which delineates the body support area of the seat cushion. Bead 44 also serves an ornamental purpose besides contributing some reinforcing effect at the perimeter.

The foregoing described blank or sheet of plastic material with protuberances may be made by vacuum forming, in which case all the protuberances are drawn to a common side from a planar sheet of deformable material.

Figure 5:
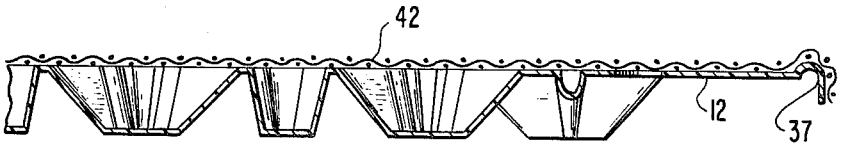
FIG. 5 is a cross-sectional view taken on the line 5—5 of FIG. 1.

Referring to FIG. 5, while the panel 12 may be used alone as a mat or cushion, the car seat of the present invention preferably utilizes a covering material 42 which is shaped and has dimensions comparable to those of panel 12. Covering material 42 and panel 12 are coextensive with each other and the material 42 can be supported upon the top surfaces of the protuberances. Of course the panel 12 may be inverted and ornamental covering material added to cover what is shown as the bottom side of the panel in the drawings. The covering material 42 can be sewn to the edges of the panel at bead 37. The covering material may be a mesh material or any other suitable cover material which is aesthetically pleasing.

Figure 6:
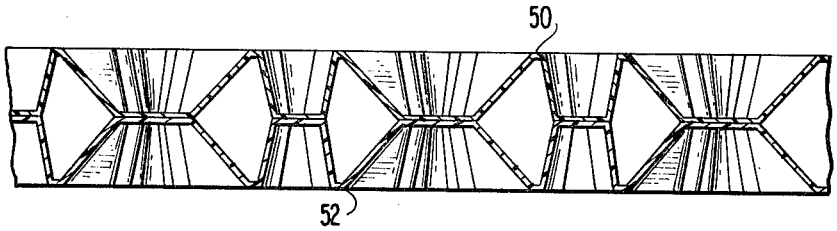
FIG. 6 is a cross-sectional view similar to FIG. 5 of a modification.

The present invention also contemplates the utilization of more than one panel in the formation of a body support seat. One possible arrangement of combined panels is shown in FIG. 6. Here two panels 50, 52 corresponding to panel 12 are shown coextensively arranged to cause corresponding protuberances to be in abutment with each other. The two panels can be connected together in any desired manner. A cover material on one or both sides may be used if desired.

Figure 7:
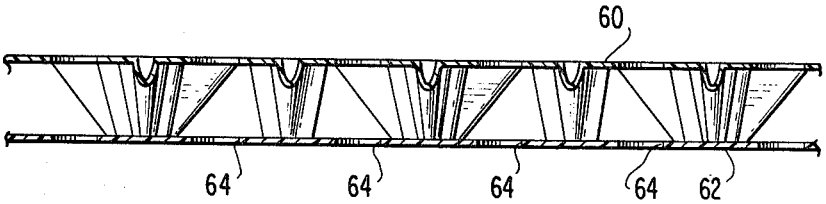
FIG. 7 is a cross-sectional view similar to FIG. 5 of a second modification.

FIG. 7 discloses another form of device within the scope of the present invention. In this form a panel 60 corresponding to panel 12 in shape is combined with a single sheet of plastic material 62 by attaching sheet 62 to the tops of protuberances. Sheet 62 may be perforated as at openings 64.

The above described construction of the support areas 14, 16 is for purpose of illustration only, and deviations from this construction may be made without departing from the spirit of the invention. Of importance is the fact that star-shaped protuberances in adjacent rows and columns must be staggered and intermeshed to form a lattice of elongate channels which extend about the periphery of the associated star-shaped sections. The protuberances must be so arranged that the continuity along channels which are aligned along directions parallel to the rows and columns is interrupted by the protuberance extending portions whereas channels which are aligned in diagonal directions are interrupted by the main body portions of the protuberances. In this manner, ventilation is assured while the stiffness of the panel is enhanced and excessive flexing thereof, including along the lines 38', 40' of the channels 38, 40, is prevented.

What is claimed is:

1. A support panel for use as a ventilated body support member comprising a plurality of protuberances arranged in columns and rows, each of a plurality of the protuberances including a transversely extending portion and a longitudinally extending portion projecting from an intermediate portion to define a star-shaped element, the transversely extending portion being disposed along a direction parallel to the direction of the rows and the longitudinally extending portion being disposed along a direction parallel to the direction of the columns, the star-shaped elements extending between two spaced substantially parallel faces of the panel, each of the star-shaped elements having a flat surface disposed in one of the faces and having wall portions extending from the periphery of the flat surface in the one face to the other face, connecting portions collectively defining the other of the faces and extending between the wall portions in the other of said faces for connecting adjacent star-shaped elements, the star-shaped elements in adjacent rows being staggered and intermeshed, with longitudinally extending portions of star-shaped elements along the direction of the rows being disposed between longitudinally extending portions of star-shaped elements in adjacent columns and transversely extending portions of star-shaped elements along the direction of the rows being disposed between adjacent transversely extending portions of star-shaped elements in adjacent rows, the star-shaped elements providing a lattice of elongate channels each extending about the periphery of an associated star-shaped element and oriented parallel to one of the directions of the rows and columns with the continuity between said channels aligned along the directions parallel to said rows and columns being repeatedly interrupted by said star-shaped elements, whereby the stiffness of the panel is enhanced and excessive flexing thereof is prevented along all directions along said panel including the longitudinal and transverse directions of said columns and rows respectively when a body is supported on the member, and said channels are provided to permit the flow of ventilating air therethrough.

2. A support panel as defined in claim 1, wherein said material is an elastomeric plastic material.

3. A support panel as defined in claim 2, wherein the panel is used as a car seat and is generally rectangular and includes a first support portion and a second support portion connected by an integral hinge and each having a major central region thereof formed with said array of star-shaped elements.

4. A support panel as defined in claim 3, wherein the panel comprises two similarly formed rectangular sheets of material arranged coextensively with each other with corresponding connecting portions on the two sheets being in abutment with each other and corresponding star-shaped elements having their flat end surfaces coinciding, and connecting means for maintaining said sheets fixed in relation to each other.

5. A support panel as defined in claim 1 wherein the panel is used as a car seat and is generally rectangular and includes a first support portion and a second support portion connected by an integral hinge and each having a major central region thereof formed with said array of star-shaped elements.

6. A support panel as defined in claim 5 wherein the panel comprises two similarly formed rectangular sheets of material arranged coextensively with each other with corresponding connecting portions on the two sheets being in abutment with each other and corresponding star-shaped elements having their flat end surfaces coinciding, and connecting means for maintaining said sheets fixed in relation to each other.

7. A support panel as defined in claim 1 wherein the panel comprises two similarly formed rectangular sheets of material arranged coextensively with each other with corresponding connecting portions on the two sheets being in abutment with each other and corresponding star-shaped elements having their flat end surfaces coinciding, and connecting means for maintaining said sheets fixed in relation to each other.

8. A support panel as defined in claim 1 wherein the panel includes a flat sheet of plastic material arranged coextensively with the support panel in engagement with flat surfaces of the star-shaped elements, and means attaching the sheet of plastic material and the panel acting between the sheet and flat surfaces of the star-shaped elements.

9. A support panel as defined in claim 5 wherein the panel includes a flat sheet of plastic material arranged coextensively with the support panel in engagement with flat surfaces of the star-shaped elements, and means attaching the sheet of plastic material and the panel acting between the sheet and flat surfaces of the star-shaped elements.

* * * * *

UNITED STATES PATENT AND TRADEMARK OFFICE

CERTIFICATE OF CORRECTION

PATENT NO. : 4,143,916

DATED : March 13, 1979

INVENTOR(S) : Herbert H. Trotman; Helen H. Trotman

It is certified that error appears in the above-identified patent and that said Letters Patent are hereby corrected as shown below:

Column 4, line 23, after "effect" insert -- channel --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*